United States Patent [19]

Bessho et al.

[11] Patent Number: 5,051,032

[45] Date of Patent: Sep. 24, 1991

[54] METHOD AND APPARATUS FOR CONTINUOUSLY EXCAVATING SHAFT AND TUNNEL

[75] Inventors: Toshihiko Bessho, Tokyo; Toshimi Ino, Higashikurume; Kenichi Kaneko, Kokubunji; Toshiaki Uehara, Yachiyo; Hiroyuki Ito, Kuwana, all of Japan

[73] Assignees: Taisei Corporation; Ishikawajima-Harima Jukogyo Kabushiki Kaisha, both of Tokyo, Japan

[21] Appl. No.: 580,273

[22] Filed: Sep. 10, 1990

[30] Foreign Application Priority Data

Dec. 13, 1989 [JP] Japan ..... 1-323076
Dec. 20, 1989 [JP] Japan ..... 1-330346

[51] Int. Cl.[5] ..... F21D 9/06

[52] U.S. Cl. ..... 405/141; 299/31; 405/138

[58] Field of Search ..... 405/141, 138, 133, 143; 299/31, 33; 175/53, 61, 79

[56] References Cited

U.S. PATENT DOCUMENTS

| | | | |
|---|---|---|---|
| 3,169,796 | 2/1965 | Long et al. | 299/31 |
| 3,604,754 | 9/1971 | Hosel et al. | 299/31 X |
| 3,830,338 | 8/1974 | Svensson | 405/141 X |
| 3,958,649 | 5/1976 | Bull et al. | 175/61 |
| 4,571,122 | 2/1986 | Yamamoto et al. | 405/143 X |

FOREIGN PATENT DOCUMENTS

| | | | |
|---|---|---|---|
| 3419731 | 11/1985 | Fed. Rep. of Germany | 405/141 |
| 60-164597 | 8/1985 | Japan . | |
| 60-184196 | 9/1985 | Japan . | |
| 274791 | 3/1990 | Japan . | |

*Primary Examiner*—Dennis L. Taylor

[57] ABSTRACT

A shield excavator excavates a shaft. Then, the excavator is caused to swing to change its posture and excavate a tunnel. Thus, the shaft and the tunnel is continuously excavated by the single machine.

8 Claims, 15 Drawing Sheets

METHOD AND APPARATUS FOR CONTINUOUSLY EXCAVATING SHAFT AND TUNNEL

BACKGROUND OF THE INVENTION

The present invention relates to a method and an apparatus for continuously excavating a shaft and a tunnel.

As shown in FIG. 1, in conventional excavation of a tunnel, a shaft a is excavated by a drive or caisson method and then a shield excavator b is conveyed into a bottom of the shaft a so as to excavate a tunnel c.

In this conventional system, it is very troublesome to convey the excavator b into the shaft a. A further problem is that separate machines for respectively excavating the shaft a and the tunnel c must be provided, which will disadvantageously increase excavating costs.

In view of these, a primary object of the present invention is to provide a method and an apparatus for continuously excavating a shaft and a tunnel by a single machine.

BRIEF SUMMARY OF THE INVENTION

The present invention is directed to a method for continuously excavating a shaft and a tunnel comprising the steps of excavating the shaft by propelling a shield excavator in unison with a shield frame for excavation of the shaft, said shield frame being swingably and vertically connected to a leading portion of the shield frame, swinging said excavator to a direction of excavating a tunnel, and excavating the tunnel by propelling only said shield excavator. The present invention is also directed to an apparatus for continuously excavating a shaft and a tunnel comprising a skin plate for excavation of the shaft on a shield frame for excavation of the shaft and having descending jacks, a spherical seal body accommodated in a leading portion of said skin plate, supporting pivots on the skin plate for swingably supporting said spherical seal body about a horizontal line perpendicular to an axis of said skin plate, a peripheral seal member in the skin plate so as to contact an outer periphery of said seal body and a shield excavator supported by said seal body through an inner skin plate section.

Therefore, according to the present invention, the downwardly directed shield excavator in the vertical shaft-excavating skin plate excavates the shaft. Then, the spherical seal body is swung about the supporting pivots to cause the excavator to swing into the horizontal posture. Thus, the excavator can continuously excavate the tunnel, too.

DETAILED DESCRIPTION OF THE PREFERRED EMBODIMENTS

Figure 2:
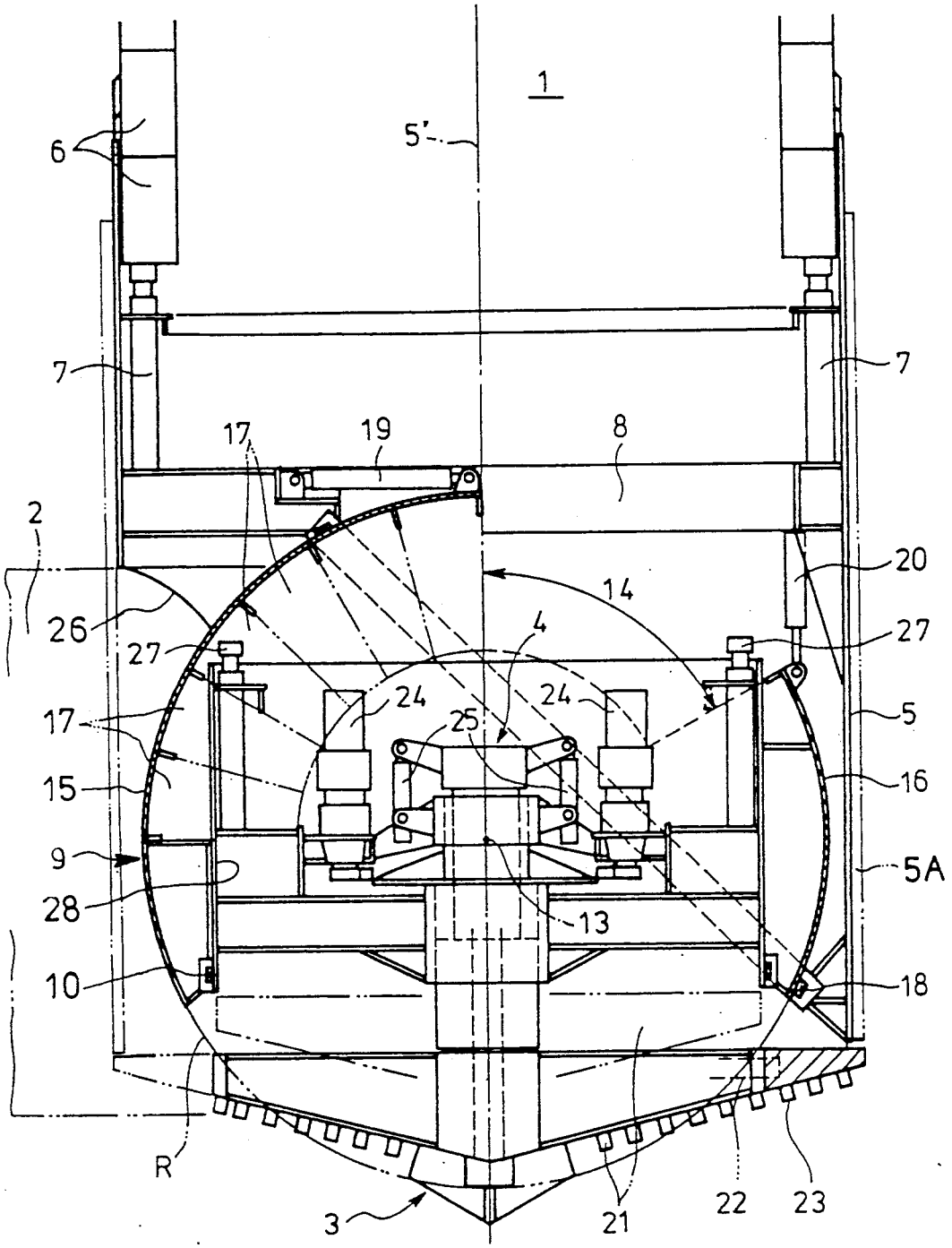
FIG. 2 is a side view in section of a first embodiment of the present invention.
Figure 3:
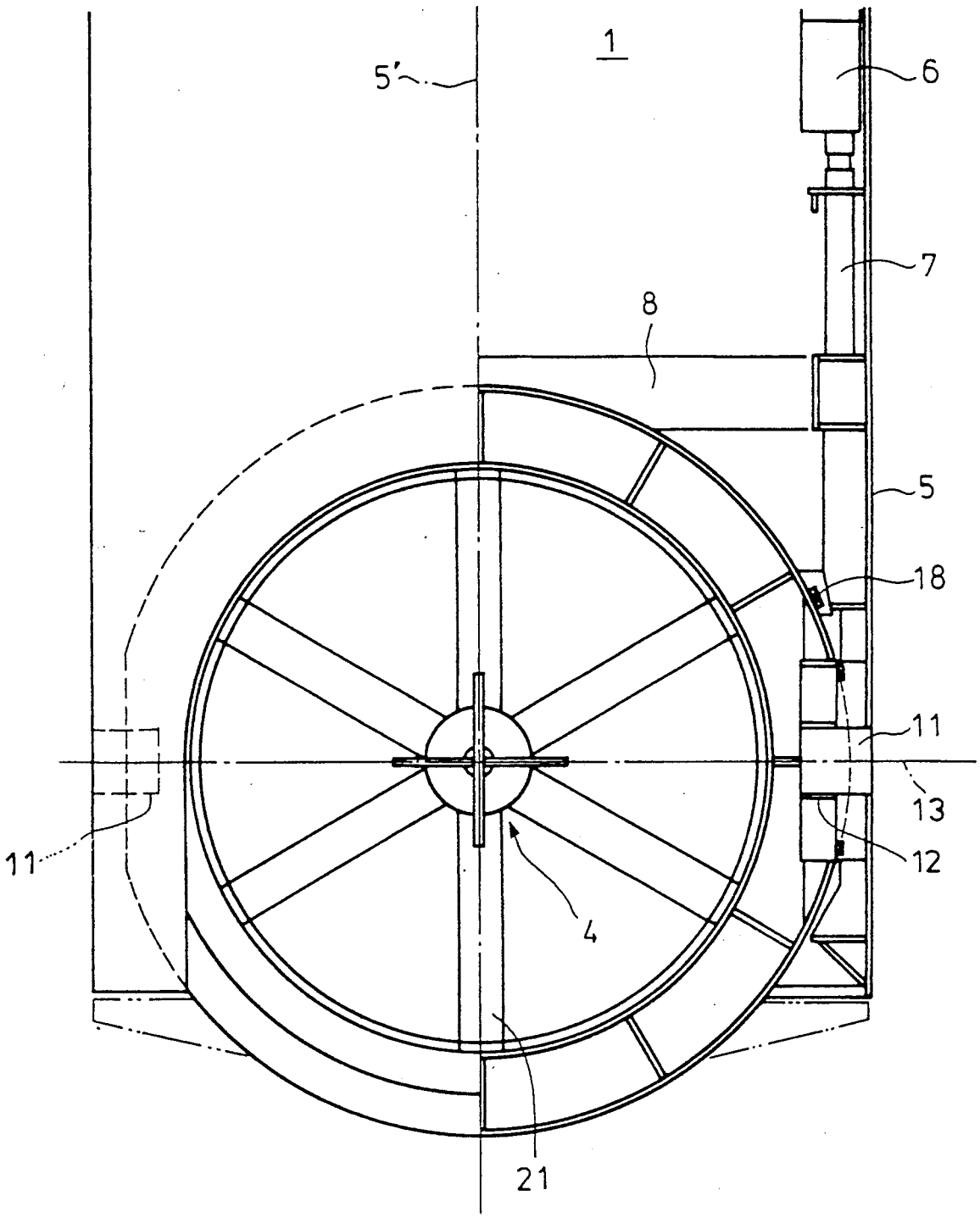
FIG. 3 is a front view illustrating swinging state of a shield excavator shown in FIG. 2 with its right half being cut away.
Figure 4:
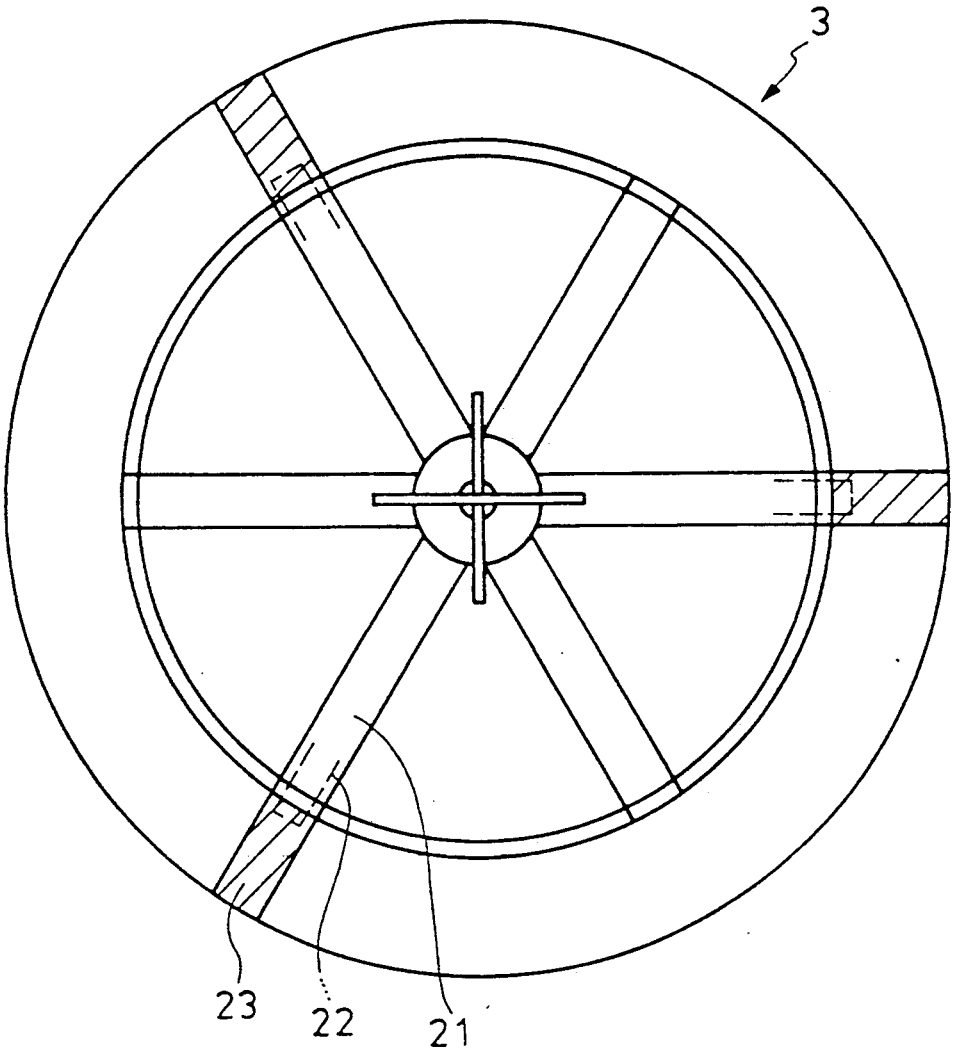
FIG. 4 is a bottom view of FIG. 2.

Referring to FIGS. 2–4, a first preferred embodiment of the present invention will be described. A shield excavator 4 is a main body of a system, is provided with cutter means 3 for excavating a shaft 1 and a tunnel 2 and is within a leading portion of a skin plate 5 only for excavation of the shaft 1. The excavator 4 is housed in a spherical seal body 9 below a shield frame 8 which is for excavation of the shaft 1, which is integral with the plate 5 and which is provided with descending jacks 7. The jacks 7 descend with their reaction forces being received by segments 6. The seal body 9 is sized to be housed within the skin plate 5.

The seal body 9 vertically movably supports an inner skin plate section 28 through a peripheral seal member 10 at the lower edge of the body 9. As shown in FIG. 3, the body 9 has right and left supports 12 which are fitted over supporting pivots 11 extending, from an inner surface of the skin plate 5, on a horizontal line 13 perpendicular to an axis 5' of the skin plate 5, so that the excavator 4 can be caused to swing in unison with the seal body 9 through 90° to the forward direction of excavating the tunnel 2 (or to the direction toward the left in FIG. 2; hereinafter, the left and right sides of FIG. 2 are respectively referred to as front and rear sides). The seal body 9 is cut off horizontally at its lower portion to expose the cutter 3 and is further cut off at its portion extending immediately above the horizontal line 13 toward the rear side by a length of arc, thereby defining an opening 14. Thus, front and rear seal sections 15 and 16 are provided.

Part of the front seal section 15 between a horizontal plane including the line 13 and a upper edge of the opening 14 is composed by a plurality of detachably interconnected plate segments 17 which are obtained by cutting the quartered spherical plate through planes including the line 13.

A peripheral seal member 18 inclined about 45° toward the front side is disposed between the front side of the frame 8 and the rear lower end of the plate 5, thereby sealing the outer periphery of the seal body 9.

The shield frame 8 has jacks 19 and 20 for detachably connecting to the plate segments 17 of the front and rear seal sections 15 and 16 respectively to swing the seal body 9 about the pivots 11.

As shown in FIG. 4, the cutter means 3 comprises an inner cutter 21 and an outer cutter 23 which is detachably engaged with an outer periphery of the inner cutter 21 by couplings 22 in the cutter 21. The outer diameter of the outer cutter 21 is made equal to that of the skin plate 5.

The connecting and disconnecting means 22 are on the inner cutters 21 so that the blocks are selectively moved into and out of the outer cutters 23 for selective connection and disconnection as shown in FIGS. 2 and 4.

The cutters 21 and 23 are rotated by a drive 24 on the excavator 4 and are vertically movable by up-down means 25.

The skin plate 5 has its lower end extending to the outer cutter 23 and has its front end cut off generally in the form of inverted U at 26 for use in excavation of the tunnel 2. Reference numeral 27 denotes jacks for advancement on the excavator 4 to excavate the tunnel 2.

In continuously excavating the shaft 1 and the tunnel 2, as shown in FIG. 2, the whole system is located or installed such that the excavator 4 is directed downwardly and is swingable to the direction of excavating the tunnel 2. The cutter means 3 is driven to excavate the shaft 2 while the jacks 7 impart propelling forces to the system until the shaft 1 is excavated to a predetermined depth. Earth and sand dug by excavating the shaft 1 are readily dischargeable through the opening 14 to the ground surface. The dug earth and sand are prevented from intruding into the upper portion of the excavator 4 since the seal body 9 is sealed by the seal member 18 against the skin plate 5 and the shield frame 8.

After the shaft 1 is excavated to a predetermined depth, continuously the excavation of the tunnel 2 is started. First, the couplings 22 are retracted to separate the outer cutter 23 from the inner cutter 21. Then, the up-down means 25 are activated to raise the inner cutters 21 into the seal body 9. The inner cutter 21 is sized to be capable of being housed in a spherical inner surface R of the seal body 9.

Figure 5:
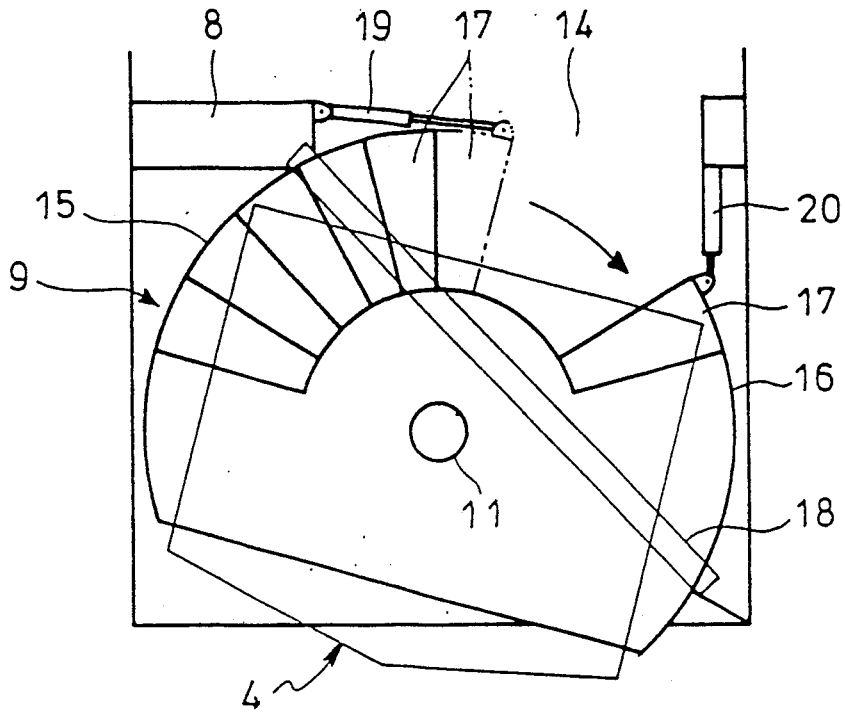
FIGS. 5–7 are side views illustrating swinging sequence of the shield excavator and mode of operation of a spherical seal body.

Thereafter, the jacks 19 and 20 are extended to cause the seal body 9 to swing about the line or axis 13 by a length of arc of one plate segment 17 as shown in FIG. 5 and then are disconnected from the associated plate segments 17. The plate segment 17 disconnected from the jack 19 is also disconnected from the front seal section 15 and is connected to the rear seal section 16 and to the jack 20. The jack 19 is connected to the succeeding plate segment 17 of the front seal section 15.

Figure 6:
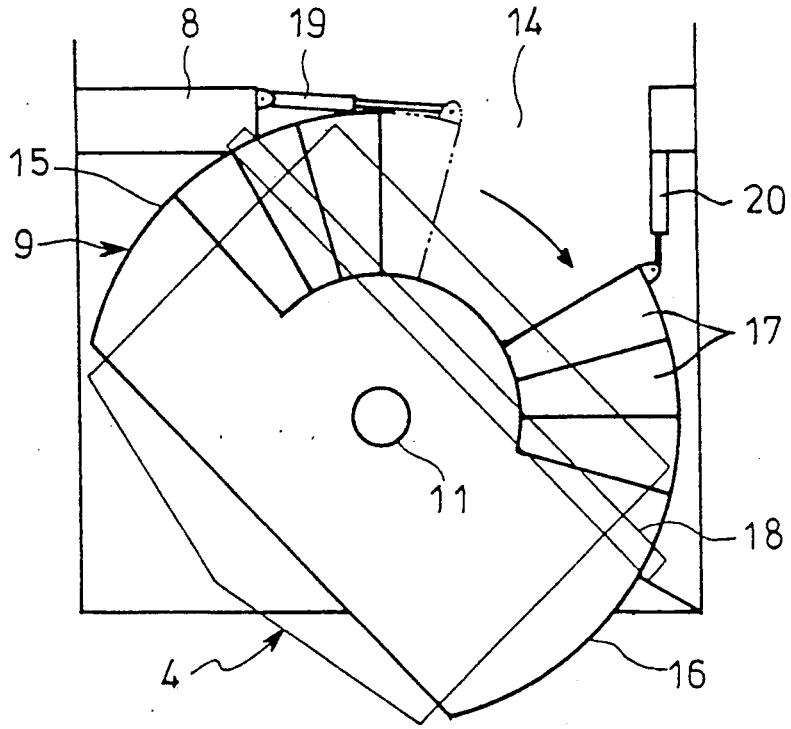
Figure 7:
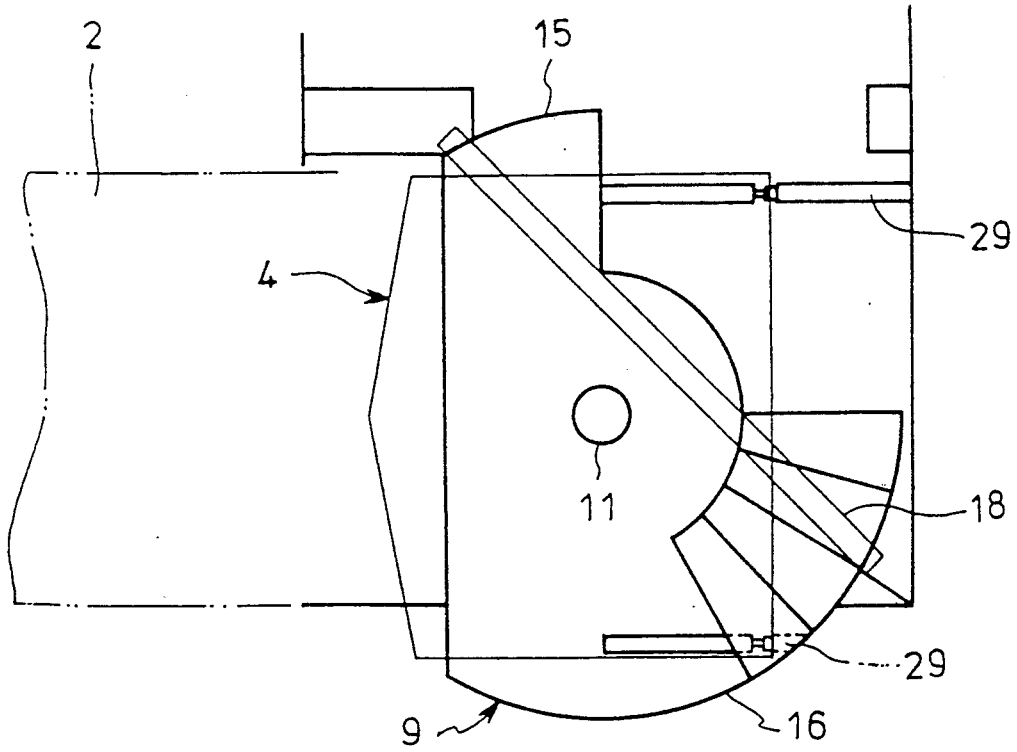

Next the jacks 19 and 20 are again extended to rotate the seal body 9 by the length of arc of one plate segment 17. As shown in FIG. 6, such operation is repeated until the excavator 4 is horizontally directed as shown in FIG. 7.

Then, unnecessary component parts are removed and required component parts are added. Back anchors 29 are attached to the inner surface of the skin plate 5 and the rear seal section 16. Reaction forces from the jacks 27 are received by back anchors 29 and the tunnel 2 is excavated while sealing is maintained at an inner skin plate section 28.

In this operation, especially in swinging of the excavator 4, the latter is completely housed within the inner surface R of the seal body 9 so that swinging of the excavator 4 can be carried out by a relatively little force in a simple manner.

In swinging of the excavator 4, the plate segments 17 are sequentially disconnected from the front seal section 15 and connected to the rear seal section 16 so that the opening 14 can be always maintained in a large size to assure a sufficient working place. Due to the sealing effect by the body 9 with the seal member 18, intrusion of dug earth and sand into the upper portion of the skin plate 5 is prevented.

So far it has been described that the disconnectable outer cutter 23 is provided; alternatively, the inner cutter 21 may be provided with an over-cutter which can be extended/retracted.

When a vertically movable sheath pipe 5A (See FIG. 2) is provided to surround the skin plate 5, resistance encountered in excavating the shaft 2 is relieved.

Figure 1:
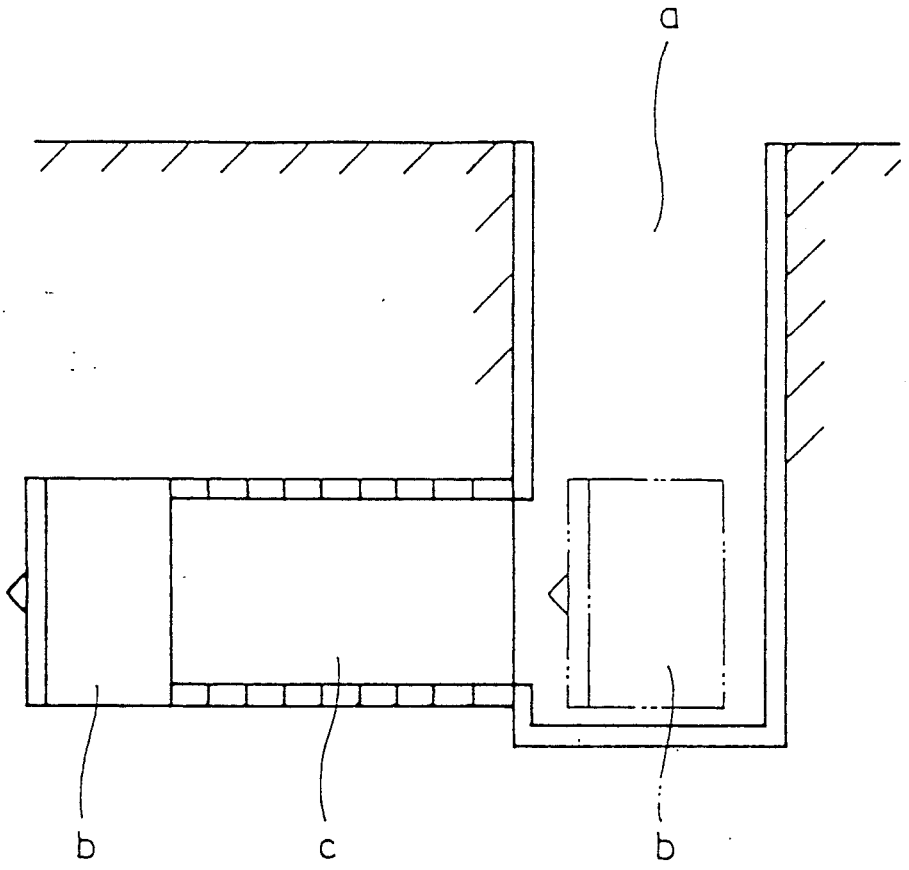
Fig.1 PRIOR ART
FIG. 1 is a schematic view illustrating a conventional system for excavating a tunnel.

Next a second embodiment of the present invention will be described with reference to FIGS. 8–10. A inner shell 30 in the form of frustum of a sphere obtained by cutting off upper and lower portions of a sphere above and below the horizontal line 13 is swingable about the line 13 and is disposed to surround the excavator 4. An outer shell 31 also in the form of a frustum of a sphere has a frustum height greater than that of the inner shell 30 and is fitted over the inner shell 30. Thus the second embodiment has a double-shell spherical seal body 32. The outer shell 31 is also swingable about the line 13 along the seal member 18 described above with reference to FIG. 1. Reference numeral 33 denotes an opening or space 31 above the outer shell 31.

Figure 8:
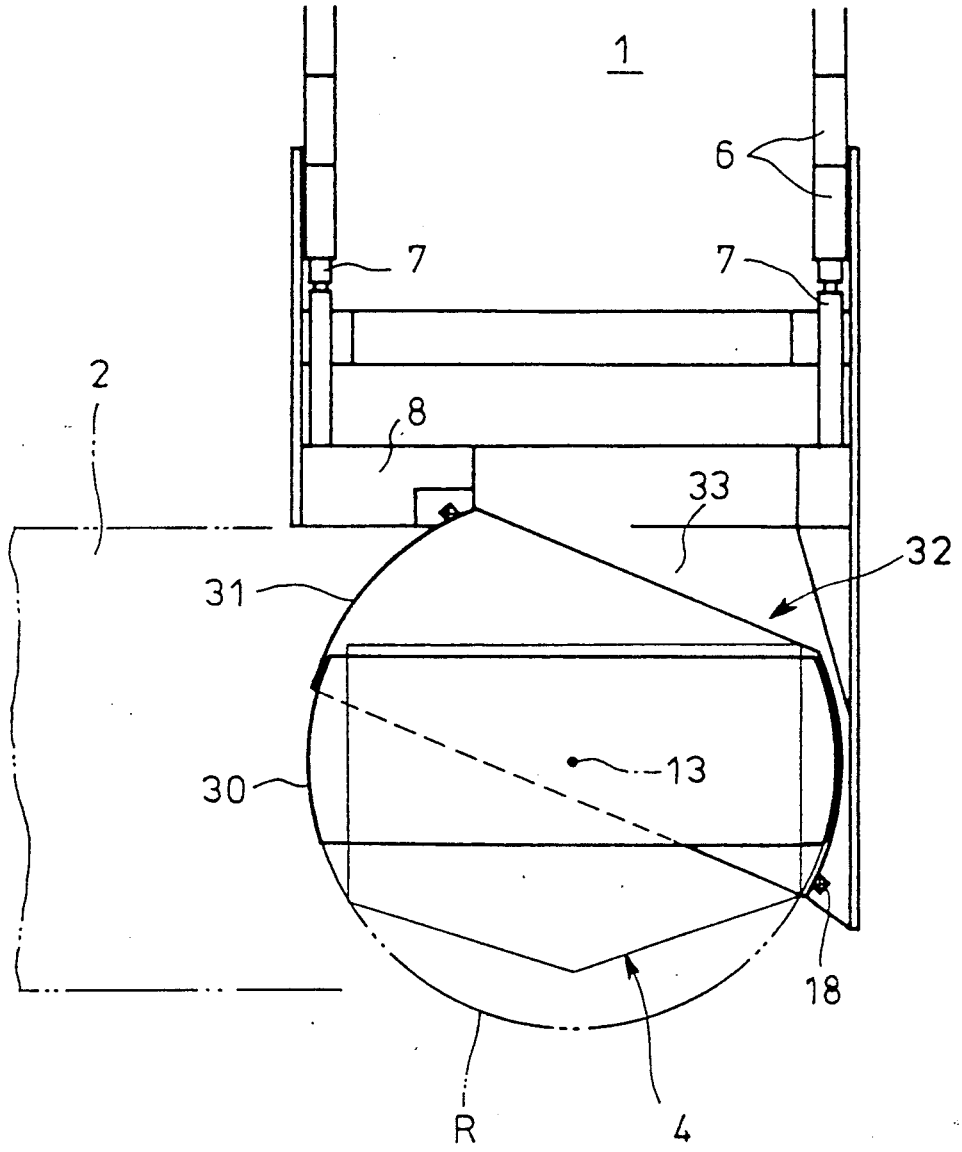
FIGS. 8–10 are side views illustrating a second embodiment of the present invention and mode of operation thereof.

FIG. 8 illustrates the state that, after the excavation of the shaft 1, a tunnel is about to be excavated where the excavator 4 is directed completely downwardly and the peripheral seal member 18 is inclined such that the member 18 contacts the front upper and rear lower sides of the outer shell 31.

Figure 9:
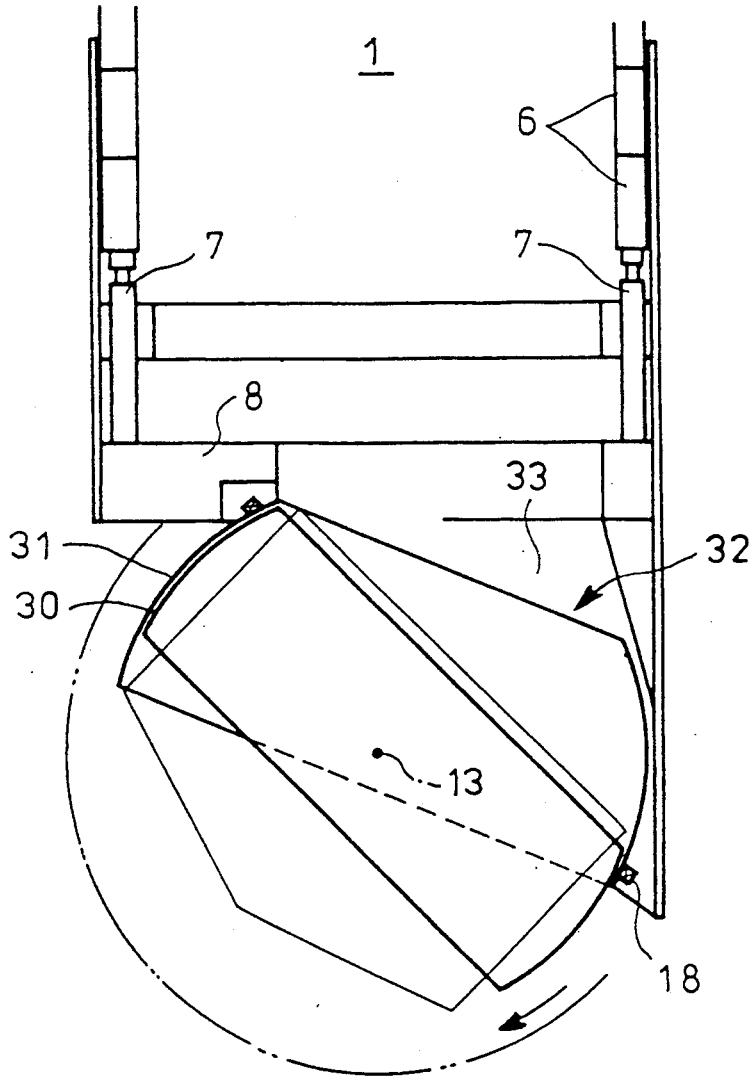

First, a jack (not shown) between the outer and inner shells 31 and 30 causes the inner shell 30 to swing as shown in FIG. 9. Then, a jack (not shown) between the shield frame 8 and the outer shell 31 causes the outer shell 31 to swing as shown in FIG. 10.

Figure 10:
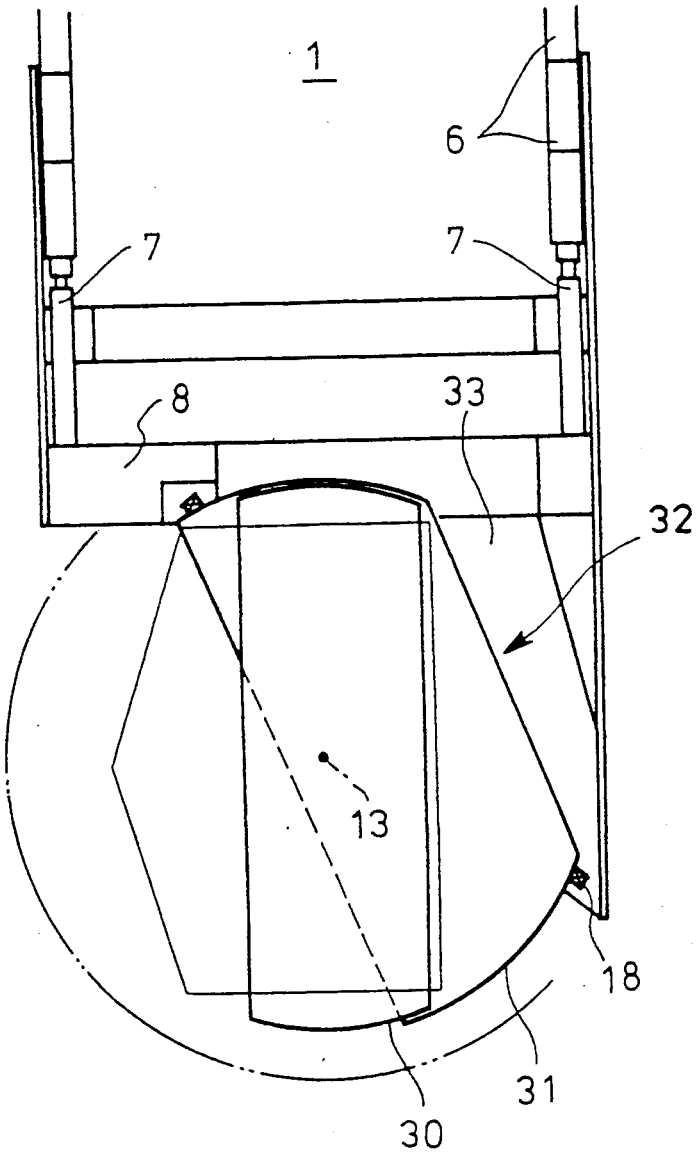

The inner shell 30 is again caused to swing with respect to the outer shell 31 as shown in FIG. 10 in a manner substantially similar to that described above, thereby locating the excavator 4 in a horizontal position or posture. Thus, the swinging operation for the inner and outer shells 30 and 31 is completed.

According to the second embodiment, the excavator 4 is housed within an inner spherical surface R of the inner shell 30, which facilitates the swinging movement. The swinging movement can be carried out while the opening 33 is always maintained and sealing is always assured between the double shell seal body 32 and the peripheral seal member 18.

Figure 11:
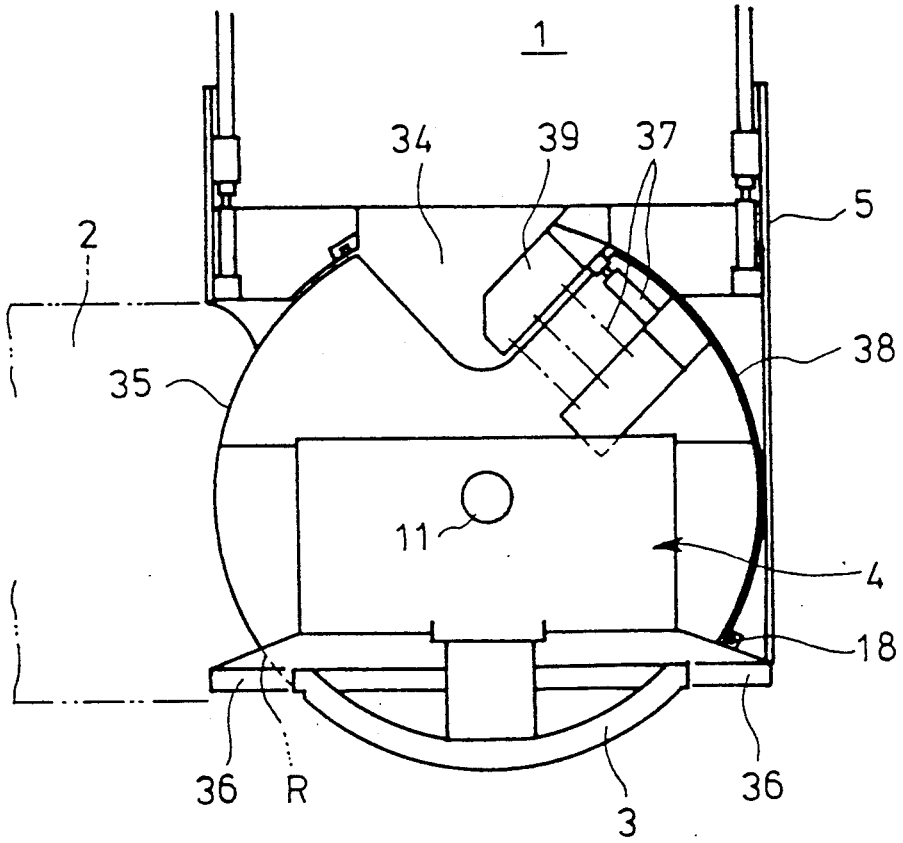
FIGS. 11–13 are side views in section illustrating a third embodiment of the present invention and mode of operation thereof.
Figure 12:
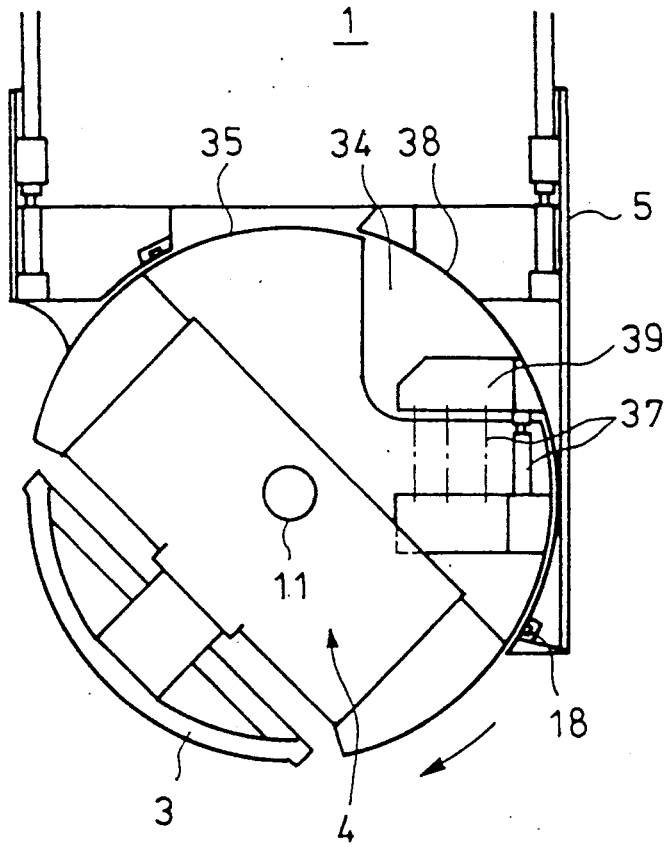
Figure 13:
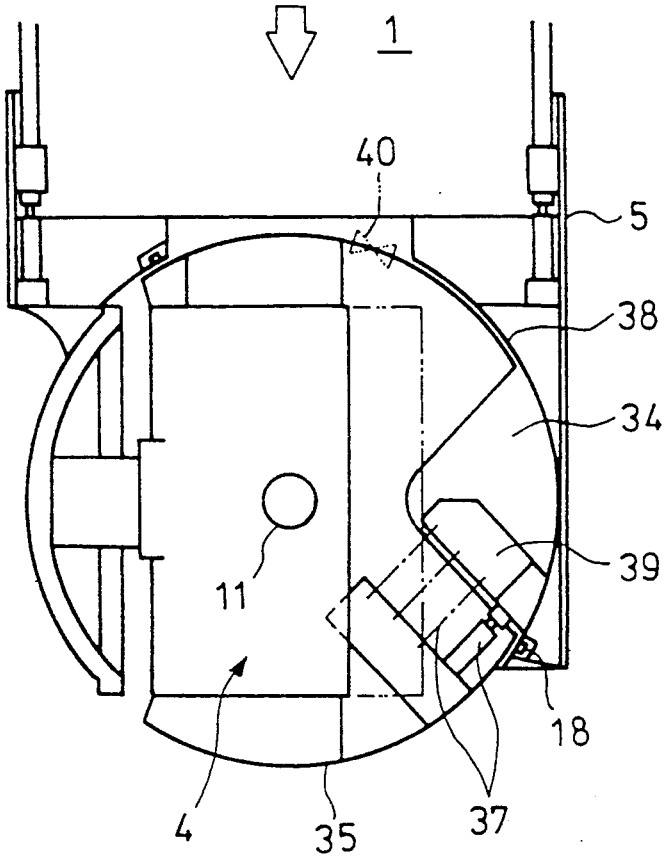

FIGS. 11–13 show a third embodiment of the present invention in which the shield excavator 4 is surrounded wholly by a single spherical seal body 35 except a upper opening 34 and a lower portion of the excavator 4. The cutter means 3 has an over-cutter 36 retractable within the inner surface R of the seal body 35 and is spherical at its lower surface. Reference numeral 37 represents swing jacks in the seal body 35; 38, a guide plate at the rear side of the shield frame 8; and 39, reaction-force receiving means.

In the third embodiment, when the excavator 4 in the position shown in FIG. 11 is to be swung, first the over-cutter 36 is retracted and the reaction-force receiving means 39 is attached to the guide plate 38 at the opening 34. The jacks 37 are extended with the reaction forces being received by the means 39 so that the seal body 35 is caused to swing over a predetermined angle; then, the attached position of the receiving means 39 is displaced as shown in FIG. 12. Such operation is sequentially carried out until the excavator 4 is located in the horizontal position or posture as shown in FIG. 13. A working opening 40 as shown in FIG. 13 is opened since the opening 34 is now away from the shield frame 8.

The third embodiment has also the shield excavator 4 which can be housed within the inner peripheral surface R of the seal body 35, which facilitates the swinging movement of the excavator 4. The swinging movement can be carried out while sealing is always assured between the single seal body 35 and the peripheral seal member 18.

Next a fourth embodiment of the present invention will be described with reference to FIGS. 14–17. In the fourth embodiment, a shield excavator 41 having the cutter means 3 for excavating the shaft 1 and the tunnel 2 is a main body of the system. The excavator 41 is suspendedly supported at its upper end by the supporting pivots 11 on a leading end portion of the skin plate 5 which is used only for excavation of a shaft. The leading portion of the skin plate 5 above the pivots 11 is cut off through 45° and a closing plate 44 is disposed thereover; the inner skin plate section 28 which constitutes the excavator 41 is cut off, at its upper portion adjacent to the closing plate 44, through 45° downwardly starting from the portion adjacent to the pivots 11; and, the section 28 including such cut-off portion is covered with a cover 45. Thus, a space 46 for permitting the swinging movement is defined between a cut-off-portion covering portion 45*a* of the cover 45 and the closing plate 44 so that the excavator 41 can be swung in one direction (in the forward direction) by 90° about the pivots 11 by two jacks 42 and 43 (See also FIG. 15). The cutter means 3 is driven by the drive 24 on a bulk head 47 and is provided with an over-cutter 49 located along the outer periphery of a cutter frame 48.

Mounted on the the covering portion 45*a* is a spherical seal body 50A which comprises an arcuate portion 50*a* which has a radius with respect to the axis of the pivots 11 and has one end on the closing portion 45*a* and the other end extending through the closing plate 44, an end plate 50*b* which connects the other end of the arcuate portion 50*a* with the pivots 11 in coplanar relationship with the plate 44 and side plates 50*c* which close the frame structure constructed by the plates 50*a* and 50*b*. Mounted on the upper end of the excavator 41 is a spherical seal body 50B whose center is at the intersection of the axis of the inner skin plate section 28 with the axis of the pivots 11 and which is integral with the seal body 50A. Upon swinging of the excavator 41, the seal body 50A is displaced while guided by a through opening of the closing plate 44. Simultaneously, the seal body 50B is slidably guided by the inner wall surface of the skin plate 5. Thus the swinging of the excavator 41 is carried out smoothly and space defined between the seal bodies 50A and 50B is used as a passage 51 for communication of the interior of the inner skin plate section 28 with that of the skin plate 5. Reference numeral 52 is a seal member disposed on the closing plate 44 where the seal body 50A is extended therethrough, and serves to seal the sliding surface of the seal body 50A; and 53, a seal member which is disposed inside of the leading portion of the skin plate 5 and serves to seal the sliding surface of the seal body 50B.

A sheath pipe 54, which serves to maintain the straight alignment of the axis of the excavator 41 with that of the skin plate 5, is disposed to surround the excavator 41 and the outer cylindrical surface of the skin plate 5. In order to engage and disengage the sheath pipe 54 with and from the skin plate 5, a hydraulic-jack type knock 55 extendible into and retractable from the sheath pipe 54 through the skin plate 5 is mounted on the inner wall surface of the skin plate 5 as a sheath-pipe engaging and disengaging means. A wire rope 57 is engaged at its lower end with the rear end of the sheath pipe 54 so that the latter, when disengaged from the skin plate 5, may be lifted to the ground surface by the operation of a winch 56 installed on the ground surface.

Figure 14:
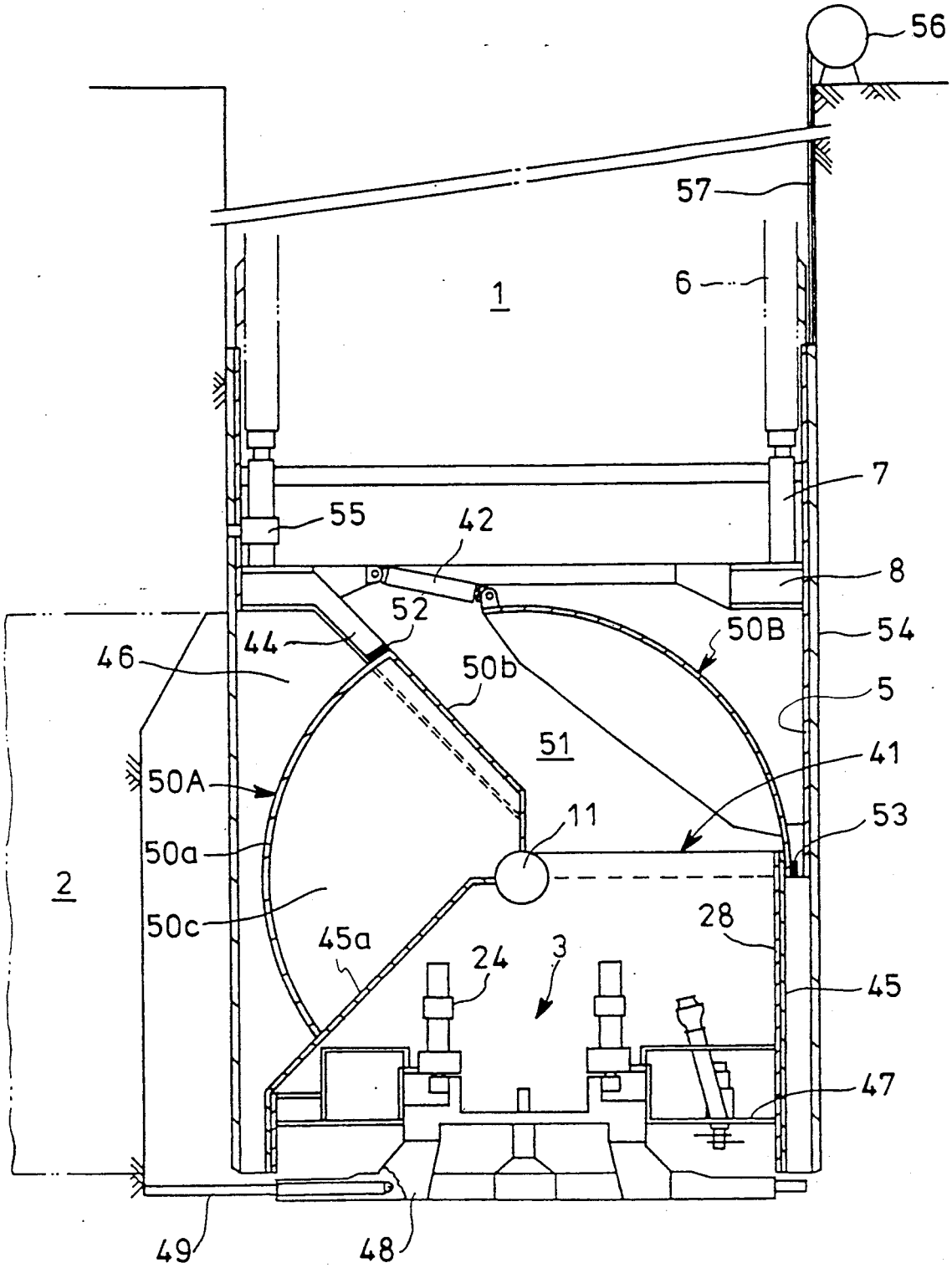
FIG. 14 is a side view in section of a fourth embodiment of the present invention.

Upon continuously excavating a shaft and a tunnel, alignment between the shield excavator 41 and the skin plate 5 is maintained by the sheath pipe 54 and, as shown in FIG. 14, the whole system is so located or arranged that the excavator 41 is directed downwardly and is swingable to the direction of excavating a tunnel 2. Excavation of the shaft 1 to a predetermined depth is carried out by driving the cutter means 3 while the thrust forces are imparted by the jacks 7. In this case, when the excavator 41 approaches the upper level of the tunnel 2 to be excavated, the over-cutters 49 positioned in the direction of swing of the excavator 41 are extended radially outwardly from the outer periphery of the cutter frame 48, thereby excavating the natural ground on one side of the seal body 50*a* to provide a space through which the excavator 41 can be swung. Earth and sand dug in excavating the shaft 1 are readily discharged to the ground surface since the interior of the inner skin plate section 28 is communicated with that of the skin plate 5 through the passage 51 defined by the seal bodies 50A and 50B. Even when any dug earth and sand happen to enter from the space between the pipe 54 and the inner skin plate section 28 into the sheath pipe 54, they cannot intrude into the plate section 28 and the skin plate 5 since the plate section 28 is covered with the cover 45, the skin plate 5 is closed by the closing plate 44 and the seal members 52 and 53 are disposed on the sliding portions of the seal bodies 50A and 50B.

Figure 15:
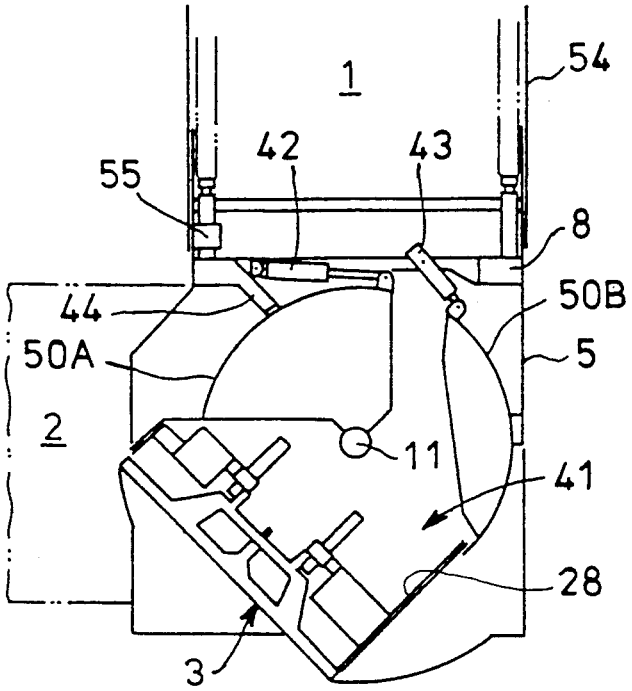
FIGS. 15–17 are schematic views illustrating steps of continuously excavating a shaft and a tunnel by the machine shown in FIG. 14.
Figure 16:
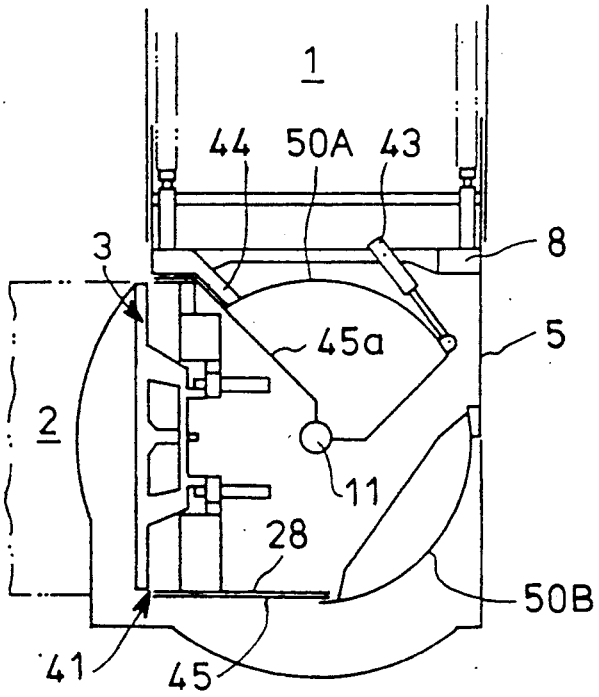

Thereafter, in order to begin to excavate the tunnel 2, the knock 55 is retracted to disengage the sheath pipe 54 from the skin plate 5. A plurality of winches 56 installed on the ground surface are energized to wind the wire ropes 57 which are securely fixed to the sheath pipe 54, thereby lifting the latter simultaneously with retraction of the over-cutter 49 which has been extended. Then the cutter means 3 is driven to dig the natural ground in front of the cutter means 3 while the jack 42 connecting the shield frame 8 with the seal body 50A is extended to swing the excavator 41. In this case, it is impossible to swing the excavator 41 through 90° only one jack 42; therefore, as shown in FIG. 15, additional jack 43 is used and the operation of the jacks 43 and 42 are alternately switched to swing the excavator 41 through 90° in the direction of the tunnel 2 to be excavated as shown in FIG. 16. The excavator 41 is smoothly swung since the seal body 50A is guided by the through opening of the cover plate 44 and the outer surface of the seal body 50B is guided by the inner surface of the skin plate 5.

Figure 17:
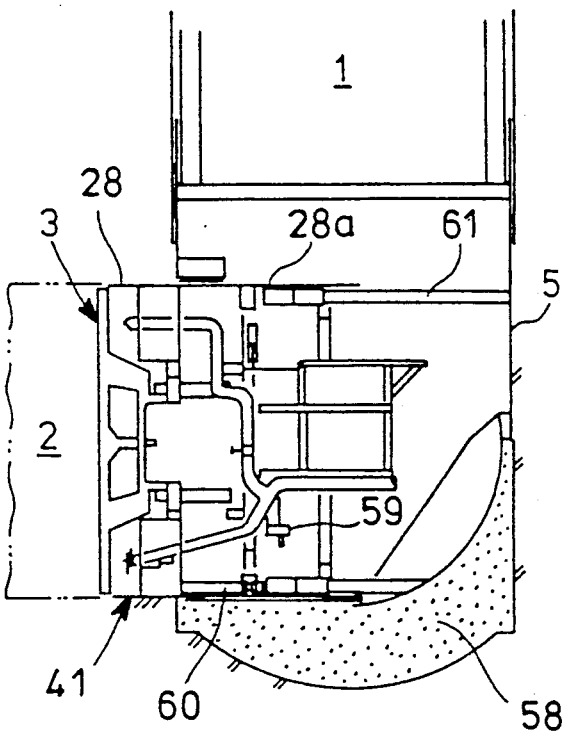

Upon completion of the swinging movement of the excavator 41, a hole is made through, for instance, the seal body 50B and a back fill material 58 is injected through this hole to solidify or improve the ground below the excavator 4 as shown in FIG. 17. The shield jacks 42 and 43, the seal body 50A, the supporting pivots 11, the cut-off portion closing portion 45*a* and so on are removed and additional inner skin plate member 28*a* is joined to the rear end of the inner skin plate section 28 to prolong the latter in the form of pipe. Within the prolonged cylindrical inner skin plate section 28, various equipments are disposed such as an elector 59, a shield jack 60 and so on required for carrying out a shield method. In order to receive the reaction force of the advancing shield jack 60, a back anchor 61 is installed. Under these conditions, the excavator 41 is activated again to excavate the tunnel 2 by a conventional shield method.

Thus, by using only one shield excavator 41, the shaft 1 and the tunnel 2 can be continuously excavated.

It is to be understood that the present invention is not limited to the above-described embodiments and that various modifications may be made without leaving the true spirit of the present invention. For instance, the sheath pipe 54 may be used in the embodiments described above with reference to FIGS. 2 to 13. The swinging movement of the excavator 4 or 41 may be carried out by any suitable means instead of the swinging jacks. The dug materials may be discharged to the ground surface by a liquid transportation system or a conveyer system. In order to engage and disengage the sheath pipe 54 with and from the skin plate 5, any suitable means may be employed instead of the hydraulic-jack type knock 55.

As described above, according to the present invention, the shield excavator is swingably connected to the leading portion of the shaft-excavating shield frame so that after the shaft is excavated to a predetermine depth, the shield excavator is caused to swing to change its posture to continuously excavate a tunnel. As a result, unlike the conventional system for excavating a shaft and a tunnel, the step for conveying a shield excavator into the bottom of the shaft can be eliminated and it is not needed to provide a shield excavator for excavating a shaft and another shield excavator for excavating a tunnel independently with each other. Thus, from the standpoint of operation and expense, the present invention is much advantageous over the prior art.

When the shield excavator is so designed and constructed to be housed in a spherical seal body which in turn is disposed in the leading portion of the skin plate, the shield excavator can be caused to swing readily and with little forces without any adverse effects.

What is claimed is:

1. A method for continuously excavating a shaft and a tunnel comprising the steps of excavating the shaft by propelling a shield excavator in unison with a shield frame for excavation of the shaft, said shield excavator being swingably and vertically supported by a spherical seal body accommodated in a leading portion of the shield frame, swinging said shield excavator to a direction of excavating a tunnel while sealability is retained by said spherical seal body, and excavating the tunnel by propelling only said shield excavator.

2. An apparatus for continuously excavating a shaft and a tunnel comprising a skin plate for excavation of the shaft on a shield frame and said shield frame having descending jacks for imparting propelling forces, a spherical seal body accommodated in a leading portion of said skin plate, supporting pivots on the skin plate for swingably supporting said spherical seal body about a horizontal line perpendicular to an axis of said skin plate, a peripheral seal member in the skin plate so as to contact an outer periphery of said seal body and a shield excavator supported by said seal body through an inner skin plate section.

3. The apparatus according to claim 2 further comprising a sheath pipe vertically displaceable along the outer periphery of the skin plate and connectable to said skin plate.

4. The apparatus according to claim 2 wherein said shield excavator is houseable in a spherical surface of the spherical seal body in the skin plate.

5. The apparatus according to claim 2 wherein said spherical seal body comprises mutually detachable plate segments which are obtained by cutting a quartered sphere along planes including an axis of said pivots.

6. The apparatus according to claim 2 wherein said spherical seal body is of double shell type comprising an inner shell for accommodating the shield excavator and an outer shell swingable along said seal member and also swingable with respect to said inner shell.

7. The apparatus according to claim 2 wherein said spherical seal body is a single structure.

8. The apparatus according to claim 2 wherein said seal body is caused to swing by means of jacks.

* * * * *